United States Patent [19]

Friedman

[11] Patent Number: 4,809,889

[45] Date of Patent: Mar. 7, 1989

[54] CLOTHING DISPLAY FORM

[76] Inventor: Linda Friedman, 17 Pine Hill Rd., Closter, N.J. 07624

[21] Appl. No.: 874,960

[22] Filed: Jun. 16, 1986

[51] Int. Cl.[4] ..... D06C 5/00; A47F 7/10

[52] U.S. Cl. ..... 223/75; 223/78; D6/316

[58] Field of Search ..... 223/75, 78, 68, 66, 223/60, 112; D21/184; 446/387; 206/296, 297, 292; 211/34, 37; D6/315, 316

[56] References Cited

U.S. PATENT DOCUMENTS

| | | | |
|---|---|---|---|
| D. 161,400 | 12/1950 | Weiss | D6/316 |
| D. 195,069 | 4/1963 | Zukerman | 223/85 X |
| 751,653 | 2/1904 | Katz | 223/75 |
| 817,511 | 4/1906 | Palmenberg | 223/68 |
| 1,215,158 | 2/1917 | Isaacs | 223/78 |
| 1,305,071 | 5/1919 | Davis | D21/184 |
| 1,833,503 | 11/1931 | Sumner | 223/68 |
| 1,868,427 | 7/1932 | Moore | D21/184 X |
| 2,098,925 | 11/1937 | Schaeffer | 223/68 X |
| 2,108,927 | 2/1938 | Rice | 223/68 |
| 2,175,789 | 10/1939 | Young | 223/75 X |
| 3,234,689 | 2/1966 | Ryan | 223/68 X |
| 4,666,048 | 3/1987 | Strongosky et al. | 223/75 X |

*Primary Examiner*—Andrew M. Falik

*Attorney, Agent, or Firm*—Peter D. Aufrichtig

[57] ABSTRACT

A display form for displaying clothing, shoes or jewelry. A first display member for supporting suitable articles is in the form of either a hand or a foot. A second display member for supporting suitable articles is also in the form of either a hand or a foot. A support member coupled between the first and second display members supports the first and second display members in spaced separation.

18 Claims, 2 Drawing Sheets

FIG. 6
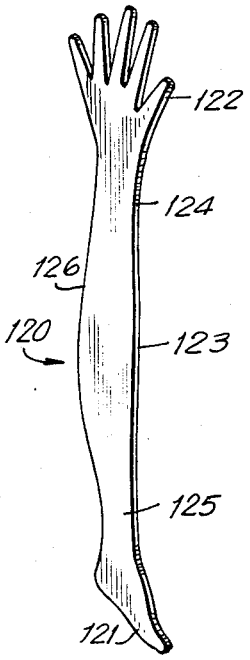
FIG. 7
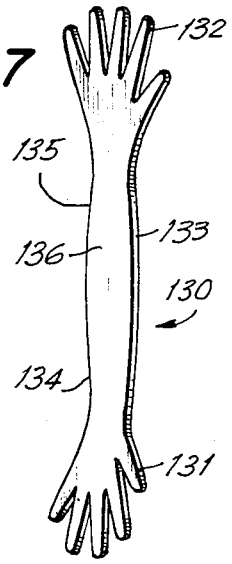
FIG. 8
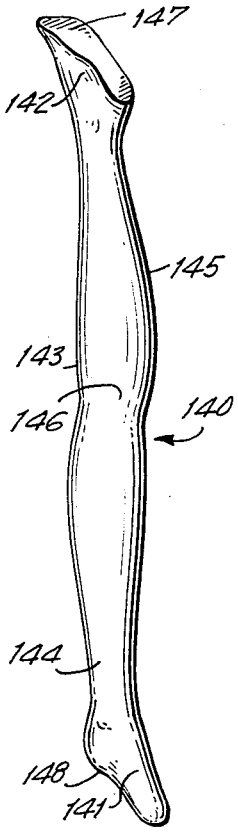
FIG. 9
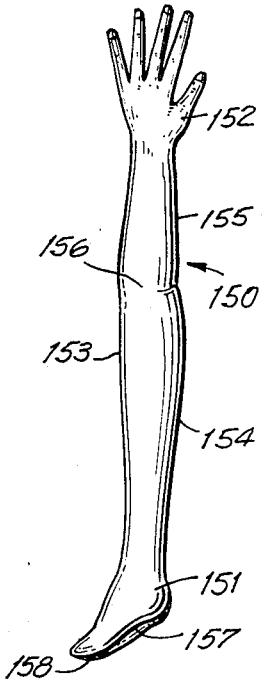
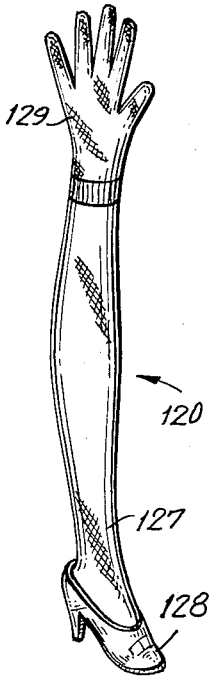
FIG. 10

CLOTHING DISPLAY FORM

BACKGROUND OF THE INVENTION

The invention is generally directed to display forms for displaying articles of clothing and in particular to display forms having hands or feet at both ends of a display form.

Display forms are used to display various articles of clothing. For example, display forms in the shape of a leg with a foot at the end can be used to display hosiery, such as pantyhose, stockings or socks, leg warmers, shoes and combinations of these articles. For example, a leg and foot display form can be used to show stockings and shoes in attractive combinations. Likewise, an arm and hand display form can be used to display gloves and jewelry.

Conventional display forms as shown in FIG. 1, 2 and 3 have a foot at the end of a leg portion. The opposite end of the display form from the foot terminates in a flat end surface as is shown in each of FIGS. 1–3. FIGS. 1 and 2 show flat display forms which are cut out of flat sheets of material into an appropriate shape FIG. 3 shows a three dimensional display form of the lower portion of the leg, terminating in a flattened top portion. In all these cases, an unnatural termination to the limb is present. In FIG. 1 the flattened ends of the three display forms are pointed downward whereas in the display forms of FIGS. 2 and 3 the flattened ends extend upward.

The display forms terminating in a flattened portion are both unsightly and inefficient as each of the display form members is only capable of displaying a single garment type. Thus two separate display forms are required to display a pair of shoes, a pair of socks, two different styles of socks or a shoe, sock and glove combination.

Accordingly, there is a need for an improved display form for displaying several garments either of the same or different types on the same display form and eliminating the unnatural termination of the display form in a flat end surface.

SUMMARY OF THE INVENTION

The invention is generally directed to a display form. The display form includes a first display member in the form of a hand or a foot for supporting a suitable garment. A second display member is also in the form of a hand or a foot. A support member coupled between the first and second display member supports the first and second display members in spaced separation.

Accordingly, an object of the invention is to provide an improved display form.

Another object of the invention is to provide an improved display form with display elements at each end of the display form.

A further object of the invention is to provide a display form for aesthetically displaying various related groupings of articles of clothing, including shoes and jewelry in a coherent and aesthetically pleasing manner.

Still another object of the invention is to provide an improved display form having two display members at the end of a central limb type supporting member where the display members are in the forms of hands and feet and the supporting member is in the form of legs or arms depending on the display members.

Yet a further object of the invention is to provide a display form with two display members in the shapes of hands or feet with an intermediate member configured as the corresponding limb adjacent the display members.

Still a further object of the invention is to provide a display form with multiple display members without an unnaturally terminating surface in a body part.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 6 is a perspective view of a display form constructed in accordance with a third embodiment of the invention;

FIG. 7 is a perspective view of a display form constructed in accordance with a fourth embodiment of the invention;

FIG. 8 is a perspective view of a display form constructed in accordance with a fifth embodiment of the invention;

FIG. 9 is a perspective view of a display form constructed in accordance with a sixth embodiment of the invention; and FIG. 10 is a perspective view of the display form of FIG. 6 covered with garments.

DETAILED DESCRIPTION OF PREFERRED EMBODIMENTS

Figure 1:
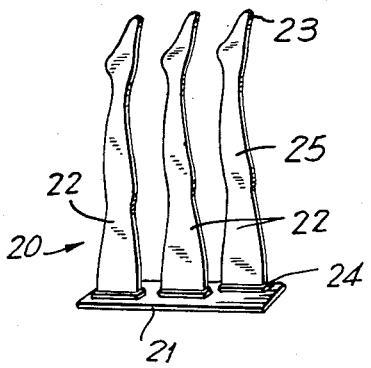
FIG. 1 PRIOR ART
FIG. 1 is a perspective view of three display forms constructed in accordance with the prior art.
Figure 2:
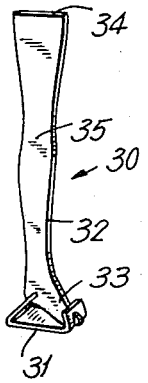
FIG. 2 PRIOR ART
FIG. 2 is a perspective view of a display form constructed in accordance with the prior art.
Figure 3:
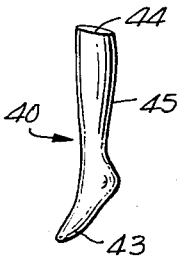
FIG. 3 PRIOR ART
FIG. 3 is a perspective view of another display form constructed in accordance with the prior art.

Reference is made to FIGS. 1, 2 and 3 wherein display forms constructed in accordance with the prior art are depicted. The display form, generally indicated as 20, in FIG. 1 includes a base 21 and three separate display forms 22 supported on base 21. Each of display forms 22 is cut out of a sheet material into the desired shape providing a substantially two dimensional display form. Display forms of this type are referred to herein as two dimensional display forms for ease of reference. Display form 22 is in the form of a leg having a foot portion 23 at one end and a flat end portion 24 at the other end. A leg portion 25 connects foot portion 23 and flat end portion 24. Leg portion 25 is cut in the general outline of a leg. Garments, such as hosiery and shoes can be displayed on each of the display forms 22.

Display form 20 of FIG. 1 has three separate display forms 22 with the foot portion extending upward. The display form shown in FIG. 2, generally indicated as 30 is another conventional display form. Display form 30 includes a support 31 for display form 32 which has a foot portion 33, top flattened end portion 34 and connecting leg portion 35. The conventional display form 30 of FIG. 2 is also a two dimensional display form.

The display form shown in FIG. 3, generally indicated as 40 is a three dimensional display form of the lower portion of a leg. Rather than being cut out of a sheet material as are the two dimensional display forms of the types shown in FIGS. 1 and 2, the three dimensional type display form is molded to generally follow the anatomical details of a human leg. Display form 40 has a foot portion 43 and an upper flattened end 44 connected by a lower leg portion 45.

Each of display forms 20, 30 and 40 shown in FIGS. 1, 2 and 3, respectively is composed of a single limb terminating in a flattened portion either alone or in a group of similar display forms.

Figure 4:
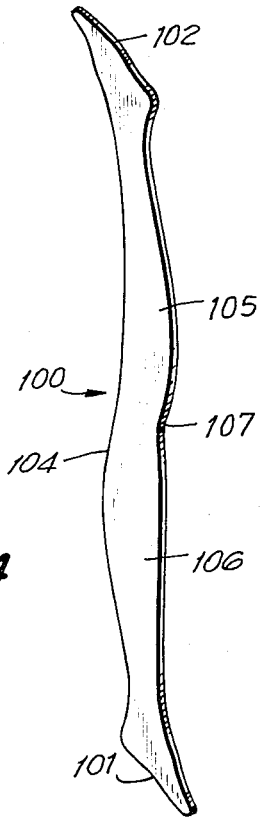
FIG. 4 is a perspective view of a display form constructed in accordance with a first embodiment of the invention.

Reference is now made to FIG. 4 wherein a display form, generally indicated as 100 constructed in accordance with a first exemplary embodiment of the invention is depicted. Display form 100 is a two dimensional type display form cut out of a sheet of thin stiff material, such as suitable plastic, as is known in the art. Display form 100 has foot portions 101 and 102 at opposite ends. Each of foot portions 101 and 102 is generally anatomically correct and sized to fit a particular shoe size for display purposes. Display form 100 also has a connecting portion 104 between feet 101 and 102. Connecting portion 104 includes two substantially collinear leg portions 105 and 106, each of which has the general shape of a human lower leg. Leg portions 105 and 106 meet in a transition region 107.

Display form 100 is adapted to display various types of garments in different combinations. The manner in which the garments are placed on the display forms constructed in accordance with the invention is shown in FIG. 10 and described in greater detail below. For example, a first stocking may be displayed over foot portion 102 and leg portion 105 with a shoe placed over foot portion 102 and the stocking. In addition, a second stocking or the same stocking can be placed over foot portion 101 and leg portion 106 with a shoe over foot portion 101 and the stocking. The stockings and shoes may be the same, showing a pair of shoes rather than a single sample. Alternatively, a single or two different stockings with different shoes may be displayed at opposite ends of display form 100. This arrangement provides a more visually appealing and functional display than the single foot and leg displays of the prior art. Display form 100 provides a sleeker and more stylish display by avoiding the use of a flattened end portion terminating the display.

Figure 5:
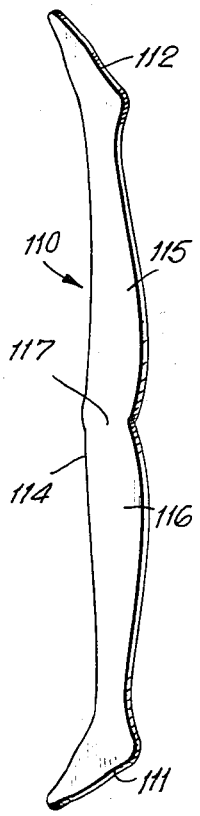
FIG. 5 is a perspective view of a display form constructed in accordance with a second embodiment of the invention.

Reference is next made to FIG. 5 wherein a display form, generally indicated as 110 constructed in accordance with a second exemplary embodiment of the invention is depicted. Display form 110 has foot portions 111 and 112 connected by a connecting portion 114 including leg portions 115 and 116 generally similar to the corresponding portions of display form 100 shown in FIG. 4. Whereas the toes on foot portion 101 and 102 point in opposite directions in display form 100 of FIG. 4, the toes on foot portions 111 and 112 of display form 110 point in the same direction.

As shown, foot portion 112 and leg portion 115 correspond to foot portion 102 and leg portion 105 of FIG. 4. However, both foot portion 111 and leg portion 116 are oriented oppositely from the corresponding foot and leg portions 101 and 106, respectively, of display form 100. As a result, the transition region 117 of FIG. 5 differs slightly from transition region 107 of FIG. 4. The difference in the direction of the toes at opposite ends of display forms 100 and 110 does not functionally change the manner in which the garments are displayed.

Reference is made to FIG. 6 wherein a display form, generally indicated as 120 constructed in accordance with a third exemplary embodiment of the invention is depicted. Display form 120 has a foot portion 121 at one end and a hand portion 122 at the other end connected by a connecting section 123. Connecting section 123 has a lower leg portion 125 adjacent to the foot portion 121 to provide the appearance of a continuous foot and lower leg, and a lower arm portion 124 adjacent hand portion 122 to provide the appearance of a continuous hand and arm. Lower leg portion 125 and lower arm portion 124 meet in a transition region 126. Display form 120 is also a two dimensional type display form cut from a sheet of suitable stock material, such as a plexiglass or other plastic material as a single piece.

Reference is made to FIG. 10 wherein display form 120 is shown covered with various garments. Display form 120 is shown in FIG. 10 as having a stocking 127 covering foot portion 121, lower leg portion 125 and extending up beyond transition area 126 onto lower arm portion 125. A shoe 128 is shown over stocking 127 on foot portion 121. Finally, a glove 129 is shown covering hand portion 122 and some of lower arm portion 124. Glove 129 overlaps stocking 127 to provide a seamless display area.

By use of display form 120 as shown dressed in FIG. 10, matching accessories can be compactly displayed in an aesthetically pleasing manner. While display form 120 is a two dimensional type display and stocking 127, shoe 128 and glove 129 are designed for the three dimensionally varying human form, they may be easily displayed on the two dimensional type form by pinning the stocking and glove in the back to form a taut display in the front.

All manners of shoes, sandals, socks, hosiery, foot warmers and foot and leg jewelry may be displayed on the foot and leg portion of display 120 or the displays of FIGS. 4 and 5. Likewise, gloves, rings, bracelets, wrist bands and other clothing and jewelry designed for the hands or lower arm may be displayed on the hand and lower arm portions 122 and 124, respectively.

Reference is next made to FIG. 7 wherein a display form, generally indicated as 130, constructed in accordance with a fourth exemplary embodiment of the invention is depicted. Display form 130 has two hand portions 131 and 132 at opposite ends of a connecting portion 133. Connecting portion 133 includes a first lower arm section 134 and a second lower arm section 135, each of which meets the heel of hand portions 131 and 132, respectively. Lower arm portions 134 and 135 meet in a transition region 136. Display form 130 is a two dimensional type display form cut from a sheet of suitable material as described above.

Display form 130 can be used to display gloves, wrist bands or other clothing worn on the hands and lower arms as well as serving as a display form for jewelry. Display form 130 can be used as a jewelry display to display rings and one or more bracelets on connecting portion 133. Display form 130 is shown as having a substantially straight connecting portion 133. However, connecting portion 133 may be curved or angled or including a joint such as a stylized elbow.

Reference is next made to FIG. 8 wherein a display form, generally indicated as 140, constructed in accordance with a fifth exemplary embodiment of the invention is depicted. Display form 140 is a three dimensional type display form unlike the two dimensional type display form shown in FIGS. 4–7. Rather than being created by cutting out a display form from a sheet of material as in the two dimensional type display forms, display form 140 must be molded or produced by a similar process to produce a display form having three dimensional detailing.

Display form 140 is substantially identical to display form 100 shown in FIG. 4 aside from the differences inherent in shifting from a two dimensional type display form to a three dimensional type display form. Display form 140 has foot portions 141 and 142 at opposite ends of a connecting section 143. Foot portions 141 and 142 are generally formed in the anatomical shape of a human foot. Foot portions 141 and 142 may or may not include detailing of toes and other features, depending upon the intended use and cost considerations. Foot portions 141 and 142 are generally formed in a standard shoe size so that shoes may easily be fitted to the display forms. Portions 141 and 142 also contain sole portions 147 and 148 which may be used as a stable base for display form 140 if no shoes are displayed. Foot portions 141 and 142 are connected by a supporting portion 143 which maintains foot portions 141 and 142 in spaced separation. Supporting portion 143 includes first and second lower leg portions 144 and 145 which meet in a transition region 146. Foot portion 141 and leg portion 144, (and foot portion 142 and leg portion 145 as well), allow the display of shoes, hosiery and jewelry as described above with regard to display forms 100 and 110 shown in FIGS. 4 and 5.

Because display form 140 is a three dimensional type display form, fitting of the garments including shoes to display form 140 is easier. It is unnecessary to pin the back of the garment together to provide a neat display of the garment. However, the three dimensional type display forms is bulkier and heavier.

Reference is next made to FIG. 9 wherein a display form, generally indicated as 150, constructed in accordance with a sixth exemplary embodiment of the invention is depicted. Display form 150 is a three dimensional type display form version of the two dimensional type display form of FIG. 6. Display form 150 has a foot portion 151, hand portion 152 and connecting portion 153. Foot portion 151 has a sole portion 157 and a toe portion 158 which may be weighted to provide stability in maintaining the displayed form upright. Connecting portion 153 includes a lower leg portion 154 adjoining foot portion 151 and a lower arm portion 155 adjoining hand portion 152. Lower leg portion 154 and lower arm 155 meet in a transition region 156.

Display form 150 can display the same garments as can display 120. As noted with respect to the relationship between the display forms shown in FIGS. 8 and 4, only minor differences in the manner of attachment of the garments are present.

Each of the two dimensional type display forms may be produced as a three dimensional type display form. In some display applications it is desirable to have a light and thin display form to conserve space, reduce the weight of the display, such as where the display is suspended by a wire or other means, or where a more stylized look is desired. However, where a more substantial display, a more natural looking display or a free standing display form is desired, the three dimensional type of display form may be preferred. In a free standing situation the two dimensional type display form generally requires support to maintain its position whereas the three dimensional type display form may be capable of standing alone unsupported.

The two and three dimensional types of display forms may be constructed out of a variety of materials in a variety of ways known in the display form art. The display forms may be transparent, flesh colored, or colored either solidly or with a pattern depending upon the display use. While the various display forms have been shown with two display members at opposite ends of a substantially straight connecting or supporting portion, more than two garments supporting members in the forms of hands and feet may meet in various shaped transition regions including stylized joint knee or elbow regions.

Accordingly, an improved display form having foot and hand display members connected by arm and leg sections without terminating in a flattened end region unsuitable for display purposes is provided.

It will thus be seen that the objects set forth above among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A display form, comprising:

first display means for supporting articles in the form of a hand;

second display means for supporting articles in the form of a foot; and support means coupled between said first and second display means for rigidly supporting the first and second display means in spaced separation, said support means including first and second substantially collinear limb means for joining with said first and second claim means, respectively for coupling said first and second limb means.

2. The display form of claim 1 wherein the first limb means is formed in the shape of an arm and the second limb means is formed in the shape of a leg.

3. The display form of claim 1 wherein the first and second display means and support means include three dimensional anatomical features.

4. The display form of claim 1 wherein the support means includes a transition section between the first and second limb means.

5. The display form of claim 4 wherein the transition section is formed with three dimensional detailing to smoothly connect the first and second limb means.

6. The display form of claim 1 wherein the display form is a substantially sheet like member.

7. The display form of claim 1 wherein the display form is formed as a single substantially flat sheet.

8. The display form of claim 1 wherein the first display means, second display means and support means are integrally formed.

9. A display form, comprising:

first display means for supporting articles in the form of a foot;

second display means for supporting articles in the form of a foot;

support means coupled between said first and second display means for rigidly supporting the first and second display means in spaced separation, said support means including first and second substantially collinear limb means for joining with said first and second display means, respectively for coupling said first and second limb means wherein the feet forming the first and second display means have a toe portion and the toe portion on the foot of the first display means points in a direction opposite to a direction in which the toe portion of the foot forming the second display means points.

10. The display form of claim 9 wherein the first display means, second display means and support means are integrally formed.

11. The display form of claim 9 wherein the first limb means is formed in the shape of a leg and the second limb means is formed in the shape of a leg.

12. The display form of claim 9 wherein the display form is a substantially sheet like member.

13. The display form of claim 9 wherein the display form is formed as a single substantially flat sheet.

14. The display form of claim 9 wherein the first and second display means and support means include three dimensional anatomical features.

15. The display form of claim 9 wherein the support means includes a transition section between the first and second limb means.

16. The display form of claim 15 wherein the first and second display means and support means include three dimensional anatomical features and the transition section is formed with three dimensional detailing to smoothly connect the first and second limb means.

17. The display form of claim 9 wherein the foot of the first display means is adapted to act as stable base for the display form.

18. The display form of claim 9 wherein at least one of the feet forming the first and second display means is adapted to act as a stable base for the display form.

* * * * *